US005262214A

United States Patent [19]

Instance

[11] Patent Number: 5,262,214

[45] Date of Patent: Nov. 16, 1993

[54] LABELS AND MANUFACTURE THEREOF

[76] Inventor: David J. Instance, Guinea Hall, Sellindge, Kent TN25 6EG, United Kingdom

[21] Appl. No.: 856,146

[22] PCT Filed: Sep. 28, 1990

[86] PCT No.: PCT/GB90/01486

§ 371 Date: Mar. 27, 1992

§ 102(e) Date: Mar. 27, 1992

[87] PCT Pub. No.: WO91/04850

PCT Pub. Date: Apr. 18, 1991

[30] Foreign Application Priority Data

Sep. 28, 1989 [GB] United Kingdom ..... 8921924
May 1, 1990 [GB] United Kingdom ..... 9009712

[51] Int. Cl.[5] ..... B31D 1/02

[52] U.S. Cl. ..... 428/40; 428/41; 428/42; 428/43; 428/136; 428/138; 428/202; 428/203; 156/227; 156/269; 156/270; 156/277; 156/301; 283/81

[58] Field of Search ..... 428/40, 41, 42, 43, 428/136, 138, 202, 203; 156/227, 269, 270, 277, 301; 283/81; 40/299

[56] References Cited

U.S. PATENT DOCUMENTS 4,544,590 10/1985 Egan ..... 428/41
4,621,442 11/1986 Mack ..... 428/40
4,744,591 5/1988 Instance ..... 428/40
4,868,027 9/1989 Hunkeler ..... 428/40
5,127,676 7/1992 Bockairo ..... 428/42

FOREIGN PATENT DOCUMENTS 192444 8/1986 European Pat. Off. .
232054 8/1987 European Pat. Off. .
2112886 9/1972 Fed. Rep. of Germany .
2199010 6/1988 United Kingdom .

*Primary Examiner*—Ellis P. Robinson
*Assistant Examiner*—Nasser Ahmad
*Attorney, Agent, or Firm*—Hill, Steadman & Simpson

[57] ABSTRACT

A method of producing a succession of self-adhesive labels on a length of release material, the method comprising the steps of:

(a) providing a length of release material which is coated on one side thereof with a layer of pressure-sensitive adhesive;
(b) providing a length of laminar material;
(c) disposing a succession of multi-laminar label pieces between the laminar material and the adhesive layer on the release material;
(d) cutting through the length of laminar material as far as the release material around the label pieces so as to form a succession of self-adhesive labels on the release material; and
(e) removing from the release material waste portions of the laminar material and of the layer of pressure-sensitive adhesive which surround the self-adhesive labels. The present invention also provides a self-adhesive label.

18 Claims, 3 Drawing Sheets

LABELS AND MANUFACTURE THEREOF

BACKGROUND OF THE INVENTION

The present invention relates to a method of producing labels and in particular to a method of producing a succession of self-adhesive labels on a length of release material. The present invention also relates to a self-adhesive label.

In the packaging field there is a great demand for high quality pre-printed labels for labelling containers of various types. In order to facilitate the packaging and labelling of containers at a fast rate it is generally required that the labels to be attached to the containers be made available in a form in which they are easy to handle and easy to transfer onto the containers for which they are intended. In one convenient arrangement the labels are self-adhesive labels which are carried in series on a web of release material which is wound into a reel. The Applicant's earlier GB-A-2199010 discloses a method of and apparatus for producing labels in which self-adhesive labels are carried directly release material.

SUMMARY OF THE INVENTION

It is an aim of the sent invention to provide an improved method for producing labels which is a development of the Applicant's earlier method.

Accordingly, the present invention provides a method of producing a succession of self-adhesive labels on a length of release material, the method comprising the steps of:- (a) providing a length of release material which is coated on one side thereof with a layer of pressure-sensitive adhesive; (b) providing a length of an uncoated laminar material; (c) disposing a succession of multi-laminar label pieces between the laminar material and the adhesive layer on the release material so that the laminar material is adhered directly to the release material by the adhesive layer; (d) cutting through the length of laminar material and the adhesive layer as far as the release material so as to form a succession of self-adhesive labels on the release material, each self-adhesive label including at least a part of a respective multi-laminar label piece and a portion of the laminar material extending thereover, with the laminar material being substantially unadhered to the label piece so that the laminar material can be separated from the label piece in order to access the label piece; and (e) removing from the release material waste portions of the laminar material and of the layer of pressure-sensitive adhesive which surround the self-adhesive labels.

The present invention also provides a self-adhesive label carried on a release material, the label comprising a laminar material, a multi-laminar label piece which is covered by the laminar material, the laminar material being uncoated whereby the laminar material is substantially unadhered to the label piece so that the laminar material can be separated from the label piece in order to access the label piece, and a layer of pressure-sensitive adhesive which releasably adheres at least apart of the self-adhesive label directly to a release material, the layer of pressure-sensitive adhesive coating the rear surface of the label piece and a portion of the rear surface of the laminar material which is adjacent the label piece.

BRIEF DESCRIPTION OF THE DRAWINGS

Embodiments of the present invention will now be described by way of example only with reference to the accompanying drawings, in which.

DETAILED DESCRIPTION OF THE PRESENTLY PREFERRED EMBODIMENTS

Figure 1:
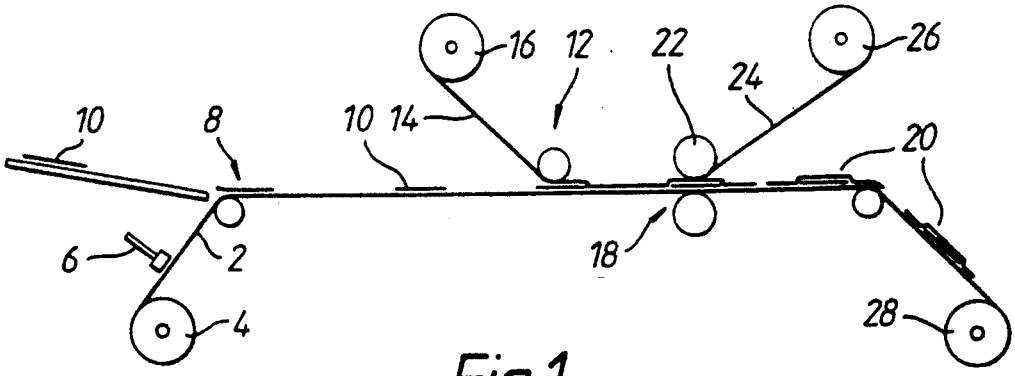
FIG. 1 is a diagrammatic elevation of an apparatus for producing self-adhesive labels in accordance with the present invention.

Referring to FIG. 1, there is shown an apparatus for producing labels in accordance with the method of the present invention. A web of release material 2 is fed out from a reel 4 thereof past an adhesive applicator 6 which is adapted to deposit a layer of pressure-sensitive adhesive (not shown) over the upper surface of the release material 2. The release material, 2 typically comprises waxed or siliconised paper. The adhesive may be extruded in a hot melt form and may be extruded either as a continuous uniform layer or in a form of a row of extruded beads. The adhesive-coated release material 2 then passes to a label piece applying station 8 at which a succession of individual multi-laminar label pieces 10 are applied to the layer of pressure-sensitive adhesive so as to adhere the label pieces 10 to the release material 2. The label pieces may comprise lithographically printed folded strips or booklets.

In an alternative embodiment, the succession of label pieces is applied to the laminar material and then the layer of pressure-sensitive adhesive on the release material is applied over the label pieces and the laminar material to form a succession of self-adhesive labels on a length of release material.

The succession of label pieces 10 carried on the release material 2 is then passed to a laminar material applying station 12 at which a laminar material 14, which is fed out from a reel 16 thereof, is applied to the succession of label pieces 10 on the release material 2. The laminar material 14 comprises a web of paper which has been printed, for example by flexographic, rotary letterpress or offset printing. Alternatively, the laminar material may be plain paper (i.e. not printed) and/or coated with a layer of polyethylene. As will be described in greater detail below, the laminar material 14 incorporates a succession of perforation lines therethrough. At the laminar material applying station 12, the laminating step causes the succession of multi-laminar label pieces 10 to be disposed between the laminar material 14 and the adhesive layer on the release material 2 and the longitudinal Position of the laminar material 14 relative to the applied label pieces 10 on the release material 2 is controlled so that each label piece 10 is substantially aligned with a respective perforation line of the succession of perforation lines disposed longitudinally along the laminar material. The downwardly-directed surface of the laminar material 14 is adhered to the portions of the layer of pressure-sensitive adhesive which are not covered by the label pieces 10 which themselves are adhered to the release material 2 by the layer of pressure-sensitive adhesive. The laminar material-coated assembly then passes to a die-cutting station 18 at which the self-adhesive labels 20 in accordance with the present invention, which will be described in greater detail below, are formed by cutting through the laminar material 14 and the layer of pressure-sensitive adhesive as far as the release material 2, the cutting being around each of the label pieces 10. The die-cutting is carried out by a pair of die-cutting rollers 22. At the die-cutting station 18, a waste web remnant 24, consisting of waste portions of the laminar material 14 and of the pressure-sensitive adhesive which surround the self-adhesive labels 20, is removed from the release material 2 and wound up into a reel 26 for subsequent disposal. The succession of self-adhesive labels 20 on the release material 2 is then wound up into a reel 28 which subsequently can be mounted in an automatic labelling machine (not shown) for automatic application of the labels 20 to containers to be labelled.

Figure 2:
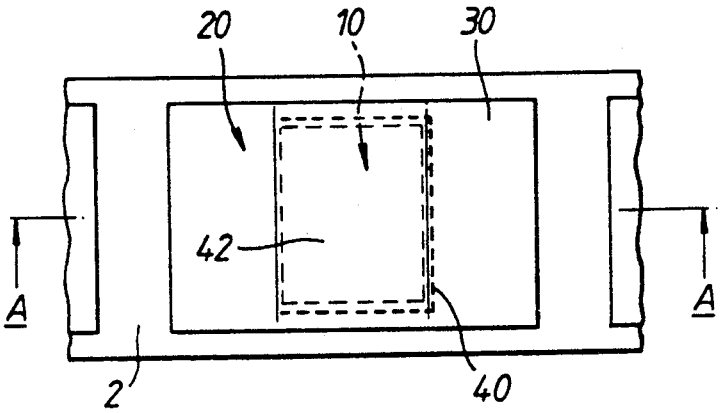
FIG. 2 is a diagrammatic plan view of a succession of self-adhesive labels in accordance with a first embodiment of the present invention when carried on a length of release material.
Figure 3:
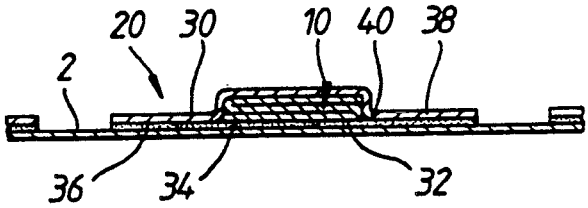
FIG. 3 is a section on line A—A of the label and release material assembly of FIG. 2.

FIGS. 2 and 3 show a succession of the self-adhesive labels 20 when carried on the length of release material 2. Each self-adhesive label 20 comprises an upper panel 30 which has been cut out at the die-cutting station 18 from the laminar material 14. The upper panel 30 covers the multi-laminar label piece 10 which has a rearwardly directed surface 32 which is adhered to the release material 2 by the layer of pressure-sensitive adhesive 34. The layer of pressure-sensitive adhesive 34 is coextensive with the upper panel 30 and thereby also adheres to the release material 2, the rearwardly-directed surface 36 of that portion 38 of the upper panel 30 which does not directly cover the label piece 10. It will be seen from FIGS. 2 and 3 that the label piece 10 is encapsulated between the upper panel 30 and the layer of Pressure-sensitive adhesive 34. The upper panel 30 has a perforation line 40 which is substantially aligned with the label piece 10 and can be torn thereby to permit access to the label piece 10 through the torn upper panel 30. The perforation line 40 is cut at the die-cutting station 18 simultaneously with the cutting out of the upper panel 30 from the laminar material. In the illustrated embodiment, the Perforation line 40 extends around three sides of the label piece 10 so as to define a flap 42 which can be torn open to reveal the label piece. However, it will be apparent to those skilled in the art that the position and configuration of the perforation line can be varied as desired—it is merely required that the perforation line 40 is substantially aligned with the label piece 10 so that when it is torn the upper panel 30 is separated so that the label piece 10 can be accessed.

Figure 4:
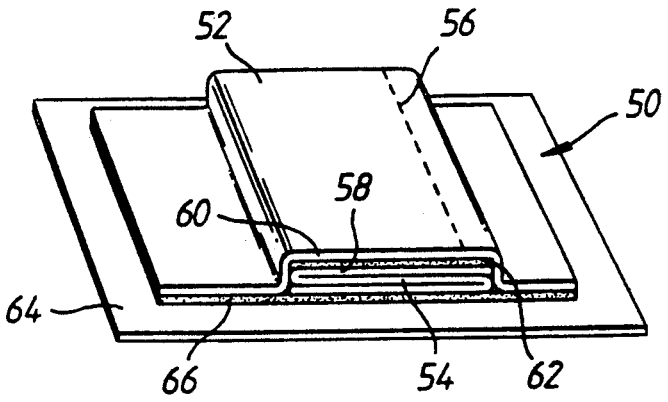
FIG. 4 is a diagrammatic perspective view of a self-adhesive label in accordance with a second embodiment of the present invention when carried on a length of release material.

FIG. 4 illustrates a further embodiment of a self-adhesive label in accordance with the present invention. In this embodiment, the self-adhesive label 50 comprises an upper panel 52 and a multi-laminar label piece 54 which has the same width as that of the upper panel 52. A perforation line 56 extends transversely across the upper panel 52 above the label piece 54. The upper longitudinally-directed edges 58 of the label piece 54 are adhered temporarily to respective corresponding edges 60 of the upper panel 52 by opposed longitudinally-directed bands 62 of dry-peel adhesive. The dry-peel adhesive bands 62 have been applied either to the label piece 54 or to the under surface of the upper panel 52 before the laminar material 14 has been applied over the label pieces 10. The dry-peel adhesive bands 62 are employed temporarily to adhere together the label piece 54 and the upper panel 52. This temporary adhesion is required when the self-adhesive label 50 is fed off from the release material 64 to which it is adhered by the layer of pressure-sensitive adhesive 66 in a label applicator for application of the label to a product to be labelled. The self-adhesive label 10 is stripped off the release material 64 and the dry-peel adhesive bands 62 ensure that the label piece 54 and the upper panel 52 are removed from the release material 64 as a single unit and are then subsequently applied as a single unit to a product to be labelled and adhered thereto by the layer 66 of pressure-sensitive adhesive. Thus the bands of dry-peel adhesive ensure that the label piece 54 and the upper panel 52 are not separated from each other during application of the labels. After labelling, the label piece 54 can be accessed by tearing along the line of perforations 56. The dry-peel adhesive bands 62 only temporarily adhere the upper panel 52 to the label piece 54 so that the torn upper panel 52 can easily be pulled away from the top surface of the label piece 54. Suitable dry-Peel adhesives are well known to the man skilled in the art.

In accordance with the present invention, the upper panel may be comprised of a paper web which has a printed top surface. Alternatively, the upper panel may comprise a plastics web which has been printed on its top surface and also on its under surface.

Figure 5:
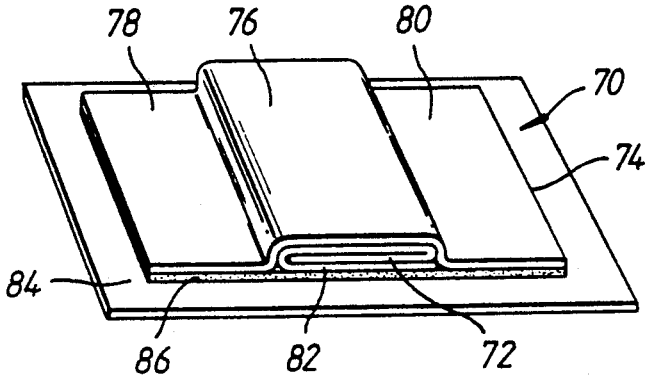
FIG. 5 is a diagrammatic perspective view of a self-adhesive label in accordance with a third embodiment of the present invention when carried on a length of release material.
Figure 6:
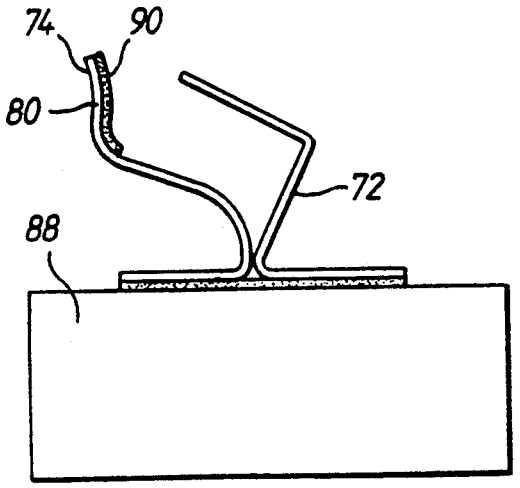
FIG. 6 is an elevational view of the label of FIG. 5 in an open configuration and when adhered to a product.

FIG. 5 illustrates a self-adhesive label in accordance with a third embodiment of the present invention. The label can be made by the apparatus illustrated in FIG. 1. In this embodiment, the self-adhesive label 70 comprises a folded printed sheet 72 and a laminar material 74 which extends over and covers the folded sheet 72. The sheet is preferably printed lithographically, but may alternatively be printed by letterpress, flexographic or laser printing. The laminar material 74 comprises a central portion 76 which is disposed above the folded sheet 72 and two side portions 78, 80 each of which is disposed on a respective side of the folded sheet 72. The rearwardly-directed surfaces of the side portions 78, 80 and of the rear panel 82 of the folded sheet 72 are releasably adhered to a release material 84 by a coextensive layer of pressure-sensitive adhesive 86. The edges of the laminar material 74 are coincident with the edges of the adhesive layer 86 and in addition the longitudinal edges of the folded sheet 72 are coincident with the longitudinal edges of the laminar material 74. This is because the edges of the label have been cut in a single die-cutting operation at the die-cutting station 18 of the apparatus of FIG. 1 thereby to form the self-adhesive label 70 and waste material has been removed from the release material 84. The laminar material 74 comprises an uncoated web of plastics such as polyethylene or polyester which is opaque or transparent and is printed or unprinted as required. The label is shown in its closed configuration in FIG. 5. The label may be removed from the release material and adhered by the adhesive layer 86 to a product to be labelled and this is illustrated in FIG. 6 wherein the label 70 is adhered to a product 88. In FIG. 6, the label is shown in its open configuration wherein the end portion 80 of the laminar material 74 has been pulled away from the product 88 and released therefrom. That portion 90 of the adhesive layer 86 which contacts the end portion 80 is pulled away from the product 88 together with the end portion 80. This permits the folded sheet to be accessed and unfolded and read by a user as shown in FIG. 6. If desired, the folded sheet 72 may be provided with a weakened tear line which permits a portion of the folded sheet 72 to be torn off and removed. After a user has read the folded sheet 72, the folded sheet 72 may be refolded and the end portion 80 of the laminar material 74 re-adhered to the product 88 by means of the portion 90 of the pressure-sensitive adhesive.

In the manufacture of the label of FIGS. 5 and 6, the release web 84 consists of a silicone-coated paper which is coated by applicator 6 with a hot melt pressure-sensitive adhesive or water-based emulsion or solvent at a rate of from 5 to 50 grams per square meter, preferably about 20 grams per square meter, so as to form a continuous adhesive layer over the release material. The folded lithographically printed sheets are then applied in succession to the adhesive layer at the label piece applying station 8 and then the uncoated polyethylene or polyester laminate is applied over the combined assembly of the folded sheets, the pressure-sensitive adhesive and the release material. The combined assembly then passes to the die-cutting station 18 at which the combined web is die-cut so as to form the resultant labels. As is shown in FIGS. 5 and 6, the die-cutting is carried out oversize to the applied folded sheets in the direction along the web of release material thereby to form the two end portions 78, 80 of the laminar material and the adhesive layer and also the longitudinal edges of the applied folded sheet are cut away. However, if desired the dimensions of the applied folded sheets may be such that the longitudinal edges thereof are not cut during the die-cutting step. Typically, the end portions 78, 80 of the laminar material have a length in the longitudinal direction of about 10 to 20 mm. The waste web remnant is then removed and this strips off extraneous laminar material and pressure-sensitive adhesive from the release material. Together with any cut-away portions of the folded sheets thereby to form the label shown in FIG. 5.

Figure 7:
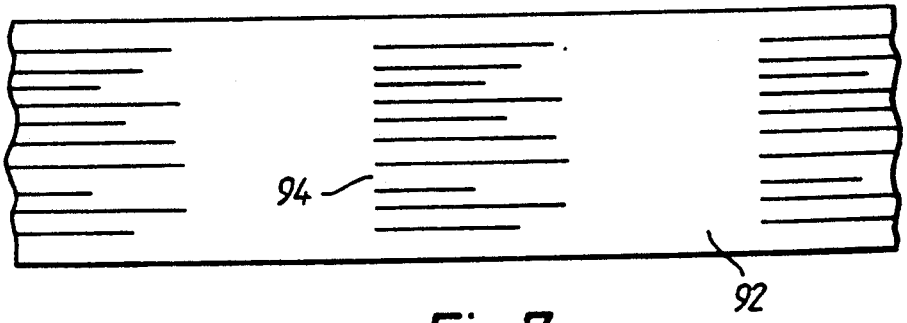
FIG. 7 is a plan view of a laminar material for use in producing labels in accordance with a fourth embodiment of the present invention.
Figure 8:
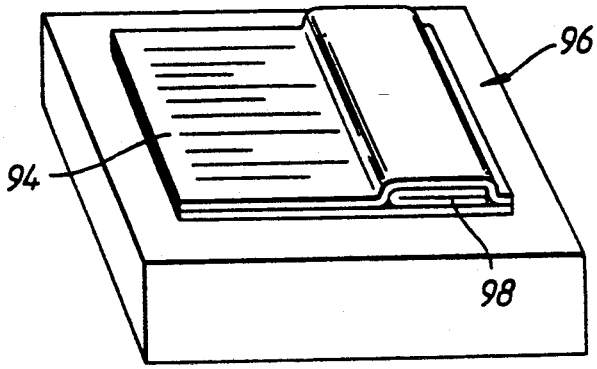
FIG. 8 is a diagrammatic perspective view of a self-adhesive label in accordance with the fourth embodiment of the present invention when adhered to a product.

A fourth embodiment of the present invention is illustrated in FIGS. 7 and 8. FIG. 7 shows a laminar material 92 for application to the assembly of sheets, pressure-sensitive adhesive and release material at the laminar material applying station 12 of the apparatus of FIG. 1. The laminar material 92 comprises a polyethylene or polyester sheet which is transparent and which is printed on its under surface with a succession of images 94. At the laminar material applying station, the laminar material 92 is applied in such a away that each image 94 is in registry adjacent a respective applied folded sheet and at the die-cutting station 18 the die-cutting is carried out in such a way that in the resultant self-adhesive label 96, which is illustrated in FIG. 8, the image 94 is adjacent a respective folded sheet 98. In other respects, the label is the same as that shown in FIG. 5.

Figure 9:
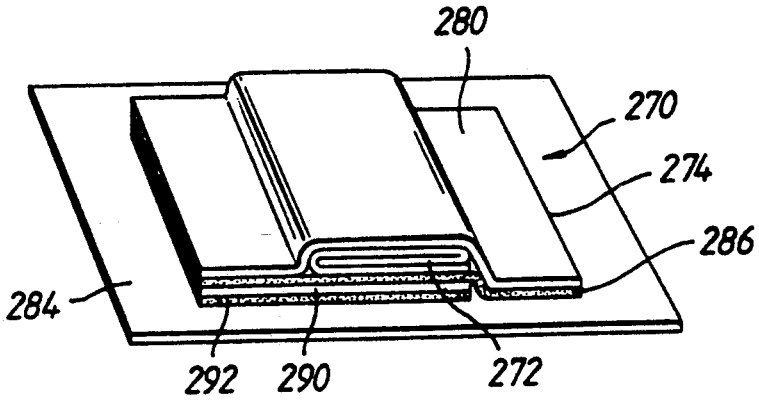
FIG. 9 is a diagrammatic perspective view of a self-adhesive label in accordance with a fifth embodiment of the present invention when carried on a length of release material.

FIG. 9 shows a label 270 in accordance with a fifth embodiment of the present invention when carried on the length of release material 284, the label 270 being a modification of the label of FIG. 5. This embodiment is different from that illustrated in FIG. 5 in that prior to the application of pressure-sensitive adhesive 272 to the release material, the release material is provided thereover with a succession of support webs, each of which comprises a layer of paper or other material which is coated on its rear surface with a pressure-sensitive adhesive and is carried on the release material. These support webs have been produced by die-cutting pressure-sensitive stock, comprising the paper or other material releasably adhered on the release paper, with the waste remnant having been removed. Thus in the apparatus of FIG. 1 the reel 4 comprises the release material 2 with a succession of self-adhesive support webs thereon. Referring to FIG. 9 again, the self-adhesive label 270 has a lower self-adhesive support web 290 e.g. of paper which is coated on its rear surface with a layer 292 of pressure-sensitive adhesive and is releasably adhered to the release material 284. The support web 290 is coextensive with all of the self-adhesive label 270 apart from the free outer edge 274 of the laminar material 280 which is adjacent the folded sheet 272 and which is intended to be releasably adhered to the release material 284. Accordingly, the free outer edge 274 is directly adhered to the release material 284 by the layer 286 of pressure-sensitive adhesive which has been applied over the release material/support web combination by the adhesive applicator 6 shown in FIG. 1.

In the manufacture of the label of FIG. 9, the folded sheets have been applied in succession over the succession of support webs 290 but also ensuring that the portion (i.e the free outer edge) of the laminar material which is intended to be releasably adhered to the release material is not disposed over a part of the support web but rather is disposed over the release material. Initially, the support web which is carried on the release material is larger than that which is present in the resultant label. During the die-cutting step, the extra peripheral part of the support web is cut simultaneously with the cutting of the laminar material 280 the applied sheet 272 and the pressure-sensitive adhesive 264 and the combined waste web remnant is then removed. Thus in each resultant label the support web 290, together with the rear layer of adhesive 292, is coextensive with the majority of the label 270. The advantage of this configuration is that the support web provides extra strength and rigidity to the resultant self-adhesive labels.

In the illustrated embodiments of the present invention the succession of label pieces is applied to the layer of pressure-sensitive adhesive on the release material and then the laminar material is applied over the label pieces and the layer of pressure-sensitive adhesive. However, in alternative embodiments the succession of label pieces is applied to the laminar material and then the layer of pressure-sensitive adhesive on the release material is applied over the label pieces and the laminar material.

I claim:

1. A method of producing a succession of self-adhesive labels on a length of release material, the method comprising the steps of:

(a) providing a length of release material which is cored on one side thereof with a layer of pressure-sensitive adhesive;

(b) providing a length of an uncoated laminar material;

(c) disposing a succession of multi-laminar label pieces between the laminar material and the adhesive layer on the release material so that the laminar material is adhered directly to the release material by the adhesive layer;

(d) cutting through the length of the laminar material and the adhesive layer as far as the release material so as to form a succession of self-adhesive labels on the release material, each self-adhesive label including at least a part of a respective multi-laminar label piece and a portion of the laminar material extending thereover, with the laminar material being unadhered to the label piece so that the laminar material can be separated from the label piece in order to access the label piece; and (e) removing from the release material waste portions of the laminar material and the layer of pressure-sensitive adhesive which surround the self-adhesive labels.

2. A method according to claim 1 further comprising the step, at any stage in the method, of forming perforation ines in the laminar material whereby in each self-adhesive label a respective perforation line is substantially in registry with the respective label piece thereby to permit the label piece to be accessed by tearing along the perforation line.

3. A method according to claim 2 wherein the perforation lines are formed before step (c).

4. A method according to claim 2 wherein the perforation lines are formed in cutting step (d) by die-cutting.

5. A method according to claim 1 wherein the succession of label pieces is applied to the layer of pressure-sensitive adhesive on the release material and then the laminar material is applied over the label pieces and the layer of pressure-sensitive adhesive.

6. A method according to claim 1 wherein the succession of label pieces is applied to the laminar material and then the layer of pressure-sensitive adhesive on the release material is applied over the label pieces and the laminar material.

7. A method according to claim 1 wherein the laminar material is printed.

8. A method according to claim 7 wherein the laminar material comprises a transparent plastics material which is printed with a succession of images, in step (c) each image is located in registry with a respective label pieces and in step (d) the cutting is carried out whereby each self-adhesive lable includes at least a part of a respective image adjacent a respective label piece.

9. A method according to claim 1 wherein the length of release material, prior to being coated with the layer of pressure-sensitive adhesive in step (a), carries a succession of support pieces, each of which comprises a layer of material which is coated on its rear surface with a pressure-sensitive adhesive, in step (c) each label piece is located over a respective support piece, and in step (d) the cutting is carried out whereby in each self-adhesive label the portion of the laminar material is adhered to the support piece by the layer of pressure-sensitive adhesive.

10. A method according to claim 1 further comprising locating bands of adhesive between the laminar material and the label pieces so as temporarily to adhere together parts of the laminar material and the label pieces, the adhesive being dry on peeling part the said parts.

11. A self-adhesive label carried on a release material, the label comprising a laminar material, a multi-laminar label piece which is covered by the laminar material, the laminar material being uncoated whereby the laminar material is unadhered to the label piece so that the laminar material can be separated from the label piece in order to access the label piece, and a layer of pressure-sensitive adhesive which releasably adheres at least a part of the self-adhesive label directly to a release material, the layer of pressure-sensitive adhesive coating the rear surface of the a label piece and a portion of the rear surface of the laminar material which is adjacent the label piece.

12. A self-adhesive label according to claim 11 wherein the laminar material has a perforation line which can be torn thereby to permit access to the label piece.

13. A self-adhesive label according to claim 11 wherein the label piece is a multi-laminar folded label.

14. A self-adhesive label according to claim 11 wherein the label piece is a booklet.

15. A self-adhesive label according to claim 11 wherein the laminar material is a transparent plastics material.

16. A self-adhesive label according to claim 15 wherein the transparent plastics material carries a printed image, at least a part of which is adjacent the label piece.

17. A self-adhesive label according to claim 11 further comprising a self-adhesive support piece which is carried on the release material and to which the label piece and a second portion of the laminar material is adhered by the layer of pressure-sensitive adhesive.

18. A self-adhesive label according to claim 11 further comprising bands of adhesive between the label piece and the laminar material so as temporarily to adhere together parts of the label piece and the laminar material, the adhesive being dry on peeling part the said parts.

* * * * *